US011766086B1

(12) United States Patent
Zhao

(10) Patent No.: US 11,766,086 B1
(45) Date of Patent: Sep. 26, 2023

(54) CAP WITH A SEAMLESS SWEATBAND

(71) Applicant: Dongguan Desheng Garment Technology Co., Ltd., Dongguan (CN)

(72) Inventor: Yong Zhao, Guangzhou (CN)

(73) Assignee: DONGGUAN DESHENG GARMENT TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 17/830,329

(22) Filed: Jun. 2, 2022

(30) Foreign Application Priority Data

Mar. 29, 2022 (CN) ..... 202210326209.1

(51) Int. Cl.
*A42C 5/02* (2006.01)
*A42B 1/0182* (2021.01)

(52) U.S. Cl.
CPC ..... *A42C 5/02* (2013.01); *A42B 1/0182* (2021.01)

(58) Field of Classification Search
CPC .. A42C 5/02; A42C 5/04; A42B 1/018; A42B 1/0181; A42B 1/0182; A42B 1/04; A42B 1/041; A42B 1/02; A42B 1/22
USPC ..... 2/181
See application file for complete search history.

(56) References Cited

U.S. PATENT DOCUMENTS 2,361,345 A * 10/1944 Young ..... A42C 1/02 2/200.1
2,566,635 A * 9/1951 Reddy ..... D04B 1/24 2/175.5
4,393,519 A * 7/1983 Nicastro ..... A42C 5/02 D2/866
6,067,658 A * 5/2000 Cho ..... A42C 5/02 2/200.1
6,199,213 B1 * 3/2001 Whang ..... A42B 1/22 2/181
6,493,880 B1 * 12/2002 Lo ..... A42B 1/22 2/195.2
6,868,559 B1 * 3/2005 Wong ..... A42B 1/22 2/209.12
10,188,188 B2 * 1/2019 Passarello ..... A45D 8/36
2003/0213049 A1 * 11/2003 Hahn ..... A42C 5/02 2/181.4
2007/0245456 A1 * 10/2007 Cho ..... A42C 5/02 2/181
2008/0282448 A1 * 11/2008 Cho ..... A42C 5/02 2/181
2010/0095430 A1 * 4/2010 Higgins ..... A42C 5/02 2/181.2
2010/0154101 A1 * 6/2010 Wang ..... A42C 5/02 2/181.2
2011/0191937 A1 * 8/2011 Wang ..... D03D 3/005 139/421

* cited by examiner

*Primary Examiner* — Amy Vanatta
(74) *Attorney, Agent, or Firm* — Zhigang Ma

(57) ABSTRACT

A cap with a seamless sweatband is provided and includes a cap body, the seamless sweatband is provided on an inner brim, the seamless sweatband is provided with a sweat-absorbent cotton yarn therein. The seamless sweatband is formed integrally, and fixedly connected to the inner brim of the cap body. The cap with the seamless sweatband is made as a production, which has advantages of convenient processing procedure, lower production costs, higher productivity, more comfort, ventilation, and more convenient use.

6 Claims, 6 Drawing Sheets

CAP WITH A SEAMLESS SWEATBAND

TECHNICAL FIELD

The disclosure related to the field of cap technologies, and more particularly to a cap with a seamless sweatband.

BACKGROUND

Traditional sewing caps use low-quality materials such as an original cloth or other materials wrapped with sponge, which has increased many extra processes and costs on the cap overall testing and production, result in inconvenient production and processing.

With the increasingly high comprehensive requirements of manpower, material and quality, a cap-making industry needs a cap with a seamless sweatband by forming integrally and seamlessly. By integrating cross-industry technology, the disclosure provides a cap with a seamless sweatband being ring-shaped, seamless, knot head free and adhesive free, which greatly reduces labor costs and processes, improves production efficiency, increases product application scenarios, and promotes product quality and human affinity.

SUMMARY

The main purposes of the disclosure are to provide a cap with a seamless sweatband, which has advantages of convenient processing procedure, lower production costs, higher productivity, more comfort, ventilation, and convenient use.

In order to achieve the above purposes, the disclosure provides a cap with a seamless sweatband including a cap body, the seamless sweatband is provided on an inner brim of the cap body. The seamless sweatband is provided with a sweat-absorbent cotton yarn therein, the seamless sweatband is formed integrally. The seamless sweatband is fixedly connected to the inner brim of the cap body.

In an embodiment, the seamless sweatband is provided with a spandex fiber, the spandex fiber is provided on an outer layer of the sweat-absorbent cotton yarn.

In an embodiment, the seamless sweatband is arranged on an inner edge of the cap body.

In an embodiment, a shape of the seamless sweatband is ring-shaped.

In an embodiment, a thickness of the seamless sweatband is in a range of 1 mm to 5 mm, and a width of the seamless sweatband is in a range of 10 mm to 30 mm.

In an embodiment, the cap body includes a cap peak.

The beneficial effect of the disclosure is: the technical solution of the disclosure adopts a cap with an integrated seamless sweatband, the seamless sweatband is a knitted elastic or inelastic sweatband with knot head free and adhesive free. The seamless sweatband by whole-loop knitting reduces the traditional practice of cutting off the head after the severed processing, the complex sweatband processing procedure, and the preparation time of previous process. Therefore, using the seamless sweatband saves manpower and manufacturing costs, makes the process simply and greatly improves the production efficiency. The disclosure makes an innovation in a field of cap production, and greatly improves the overall comfort level of caps. The innovation can extend application scenarios because it can adjust materials of the seamless sweatband. It can improve social and economic benefits, save energy and reduce emissions, so it suits for widespread promotion.

BRIEF DESCRIPTION OF DRAWINGS

In order to explain the embodiments of the disclosure or the technical solutions of the prior art more clearly, the following will briefly introduce the attached drawings needed to be used in the embodiments or the description of the prior art. Obviously, the attached drawings in the following description are only some embodiments of the disclosure. For those skilled in the art, other drawings can be obtained according to the structure shown in these drawings without paying creative labor.

DESCRIPTION OF REFERENCE NUMERALS

Figure 1:
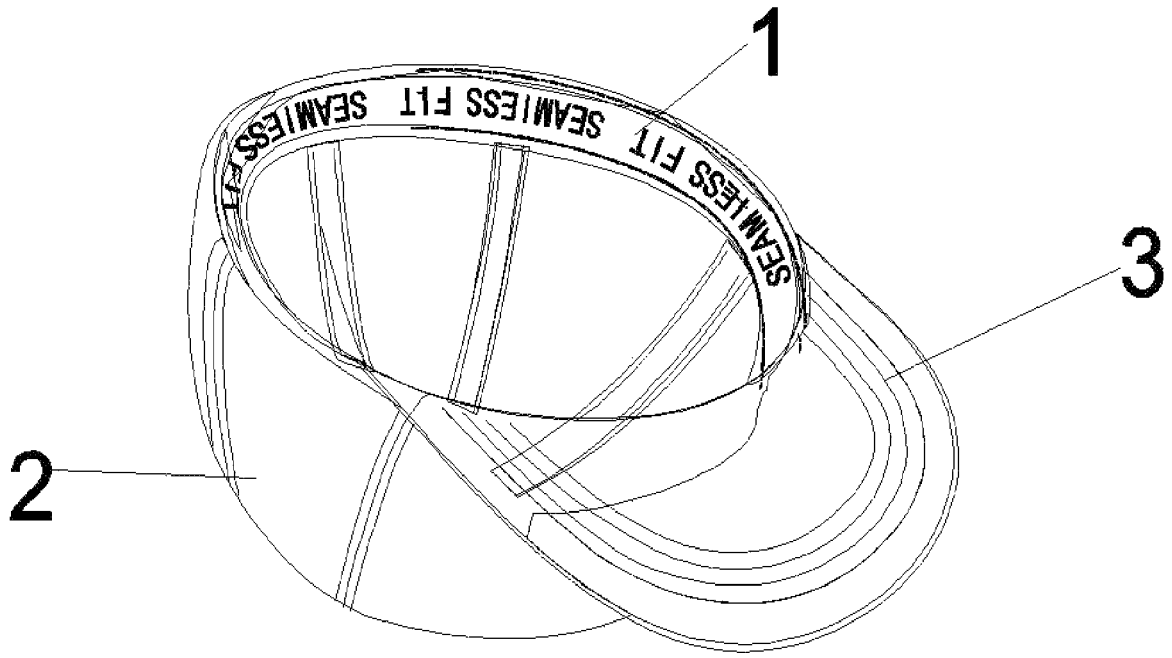
FIG. 1 is a schematic structural diagram of a cap with a seamless sweatband according to an embodiment of the disclosure.
Figure 2:
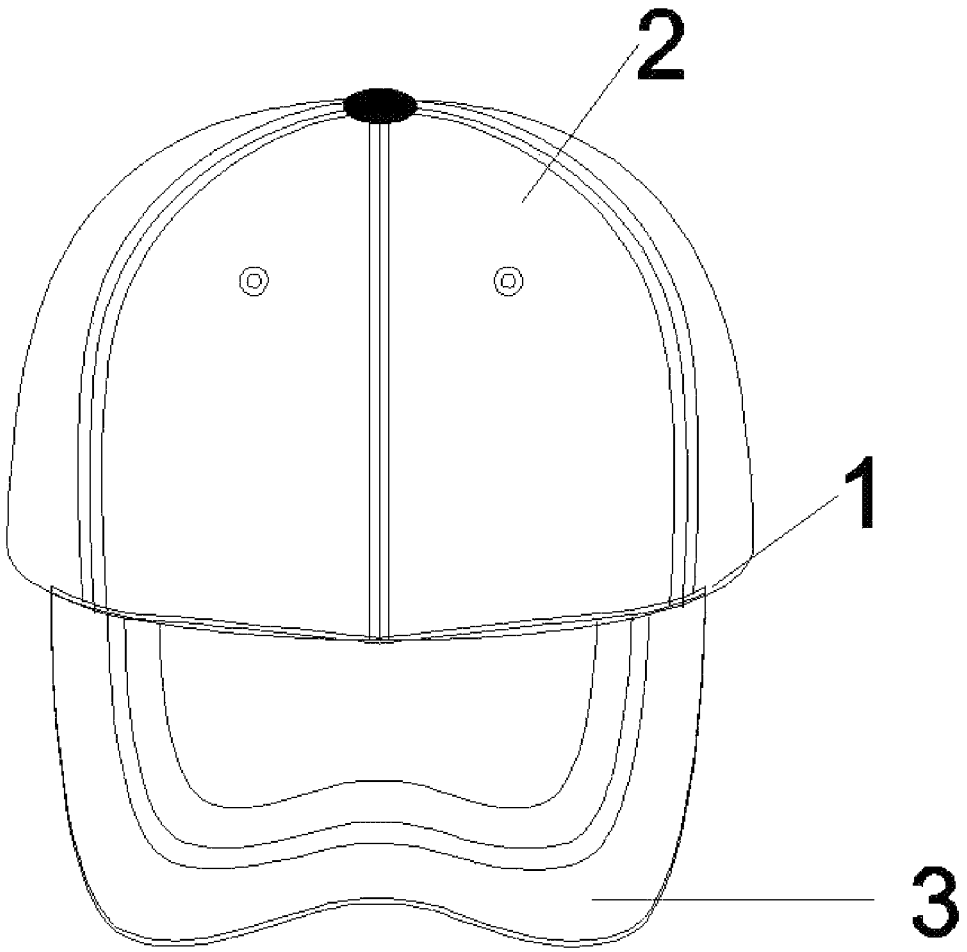
FIG. 2 is another schematic structural diagram of the cap with the seamless sweatband according to an embodiment of the disclosure.
Figure 3:
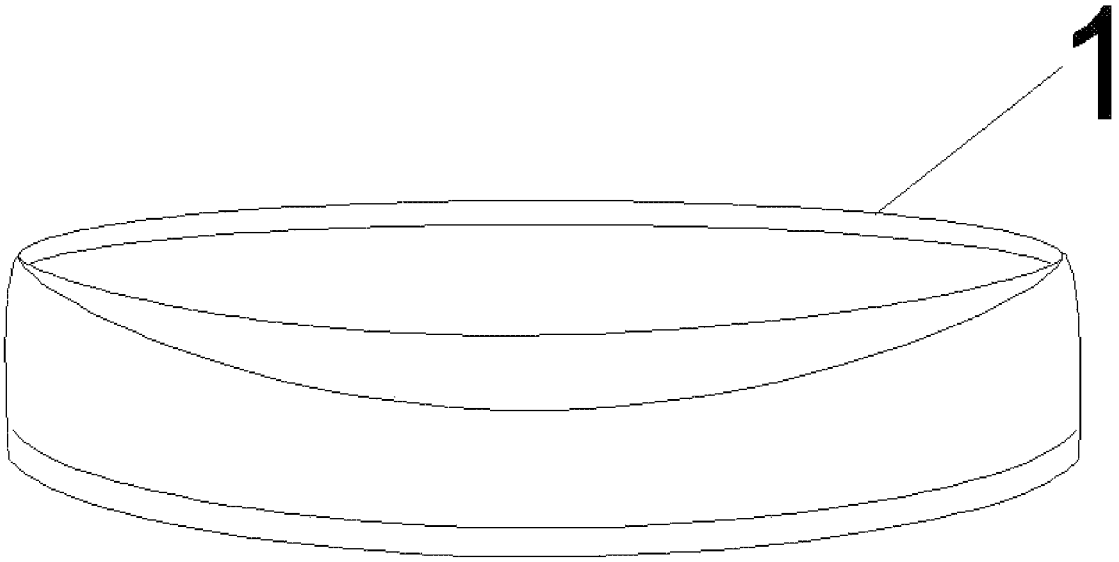
FIG. 3 is a schematic structural diagram of a seamless sweatband of a cap with the seamless sweatband according to an embodiment of the disclosure.
Figure 4:
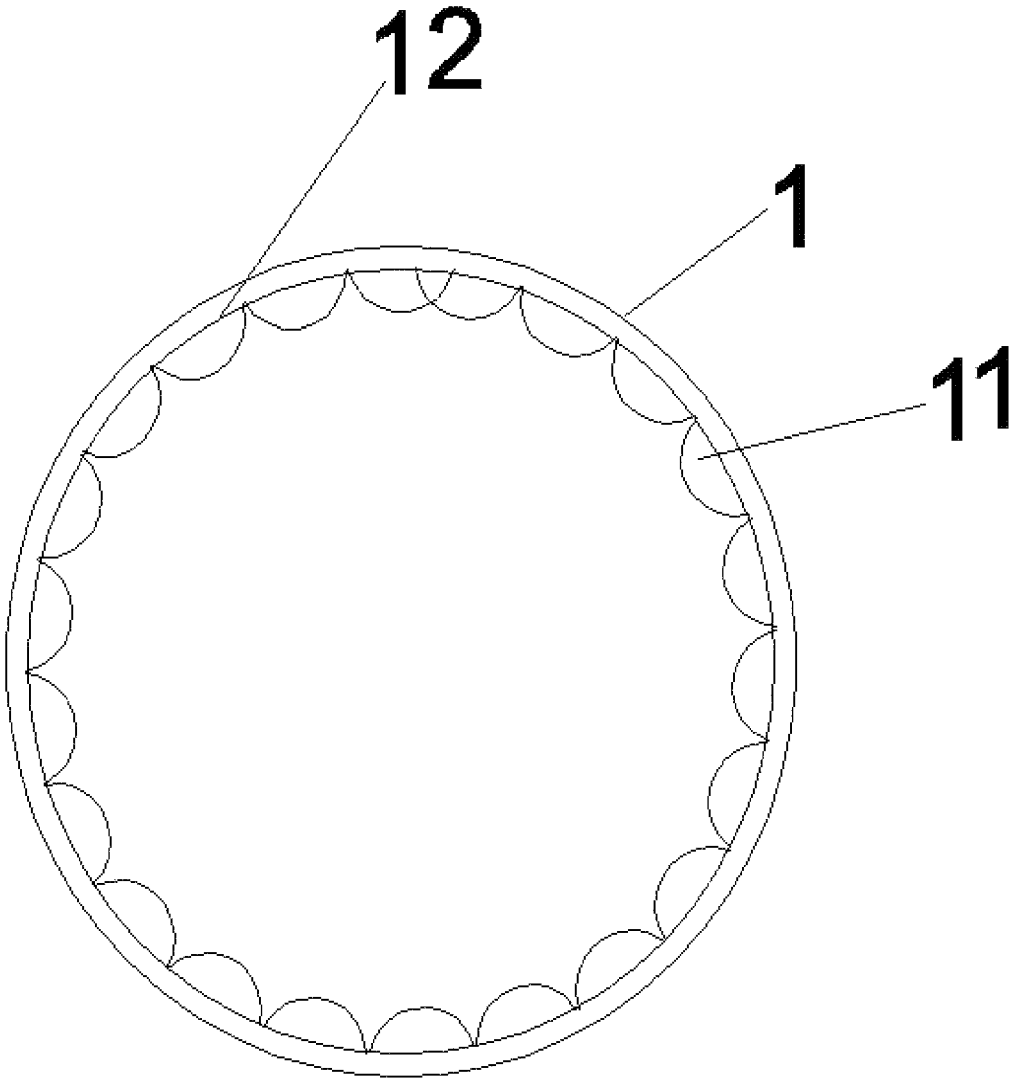
FIG. 4 is another schematic structural diagram of a seamless sweatband of a cap with the seamless sweatband according to an embodiment of the disclosure.

1—seamless sweatband; 11—sweat-absorbent cotton yarn; 12—spandex fiber; 2—cap body; 3—cap peak.

The realization of the object, the functional characteristics and the advantages of the disclosure are further explained by referring to the attached drawings in combination with the embodiments.

DETAILED DESCRIPTION OF EMBODIMENTS

The technical solutions of the embodiments of the disclosure will be clearly and completely described below in combination with the attached drawings in the embodiments of the disclosure. Obviously, the described embodiments are only some embodiments of the disclosure and not all embodiments of the disclosure. Based on the embodiment of the disclosure, all other embodiments obtained by those skilled in the art without creative work belong to the protection scope of the disclosure.

It needs to explain that all directional indications (such as up, down, left, right, front, back . . . ) in the embodiments of the disclosure are only used to explain the relative position relations, motion conditions, etc. among the components in a particular attitude (as shown in the attached drawing), if the particular attitude changes, the directional indication changes accordingly.

In the disclosure, unless otherwise specified and limited, the terms "connected", "fixed", etc. shall be understood in a broad sense. For example, "fixed" may be a fixed connection, a detachable connection, or an integrated connection; it can be a mechanical connection or an electrical connection; it may be a direct connection or an indirect connection through an intermediate medium; it may be a connection between two elements or an interaction between two elements, unless otherwise specified. For those skilled in the art, the specific meaning of the above terms in the disclosure can be understood according to the specific circumstances.

In addition, if there is a description of "first", "second", etc., in the embodiments of the disclosure, the description of "first", "second", etc., is only used to describe purposes, cannot be understood as indicating or implying its relative importance or implicitly indicating the number of technical characteristics indicated. Thus, a feature defining "first" or "second" may include at least one of the features explicitly or implicitly. Additionally, the meaning of "and/or" in the full text, includes three parallel schemes, taking "A and/or B" as an example, including a scheme "A" or a scheme "B", or a scheme "A and B". In addition, the technical solutions between various embodiments may be combined with each other, but must be based on the achievement of those skilled in the art. When a combination of technical solutions appears contradictory or cannot be realized, the combination shall be considered not to exist and not to be within the protection scope of the disclosure.

The disclosure provides a cap with a seamless sweatband.

Reference from FIG. 1 to FIG. 6, an embodiment of the disclosure provides a cap with a seamless sweatband including a cap body 2, an inner brim of the cap body 2 is provided with a seamless sweatband 1. The seamless sweatband 1 is provided with a sweat-absorbent cotton yarn 11 therein, and the seamless sweatband 1 is integrally formed and fixedly connected to the inner brim of the cap body 2.

In an illustrated embodiment of the disclosure, the seamless sweatband 1 is an inelastic seamless sweatband.

In an illustrated embodiment of the disclosure, the seamless sweatband 1 is further provided with a spandex fiber 12, the spandex fiber 12 is provided on an outer layer of the sweat-absorbent cotton yarn 11. The seamless sweatband 1 is integrally formed and the seamless sweatband 1 is fixedly connected to the inner brim of the cap body 2 through sewing.

In an illustrated embodiment of the disclosure, the seamless sweatband 1 is an elastic seamless sweatband.

In an illustrated embodiment of the disclosure, a shape of the seamless sweatband 1 is a ring-shaped.

In an illustrated embodiment of the disclosure, a thickness of the seamless sweatband 1 is in a range of 1 mm to 5 mm, and a width of the seamless sweatband 1 is in a range of 10 mm to 30 mm.

In the embodiment of the disclosure, the seamless sweatband 1 is integrally formed, which means knitted non-elastic or elastic, seamless, knot head free, no ultrasonic suture and adhesive free. The seamless sweatband by whole-loop knitting reduces the traditional practice of cutting off the head after the severed processing, and the complex sweatband processing procedure. Therefore, using the seamless sweatband saves manpower and manufacturing costs, makes the process simply and greatly improves the production efficiency.

Reference to FIG. 1, FIG. 2, FIG. 3, FIG. 4, in an illustrated embodiment of the disclosure, the seamless sweatband 1 is provided on an inner edge of the cap body 2.

In an illustrated embodiment of the disclosure, the cap body 1 includes a cap peak 3, the seamless sweatband 1 is provided on the inner edge of the cap body 2. When wearing the cap, people fit their head with the seamless sweatband 1, feeling comfortable and breathable.

In the embodiment of the disclosure, the seamless sweatband 1 with a ring-shaped, knot head free and adhesive free is used to connect the cap peak 3 and the cap body 2 to enhance the integrity of the cap.

In the embodiment, the disclosure adopts the seamless sweatband 1 with a ring-shaped, knot head free and adhesive free to reduce the sweatband processing and procedure and the production costs.

In the embodiment, the disclosure adopts the seamless sweatband 1 with a ring-shaped, knot head free and adhesive free, which can reduce the procedure and promote the production efficiency.

In the embodiment, the disclosure adopts the seamless sweatband 1 with ring-shaped, knot head free and adhesive free, which can improve the overall quality, increase the utility, save energy, reduce emissions and waste.

In the embodiment, the seamless sweatband 1 is provided with the sweat-absorbent cotton yarn 11 and the spandex fiber 12. The seamless sweatband 1 is sweat-absorbing and fast-drying. The component of the seamless sweatband 1 can adjust materials of the yarn according to the application to increase extra functions like fast drying, moisture absorption and etc. The component of the seamless sweatband 1 is made of cotton yarn or chemical fiber and spandex fiber.

Figure 5:
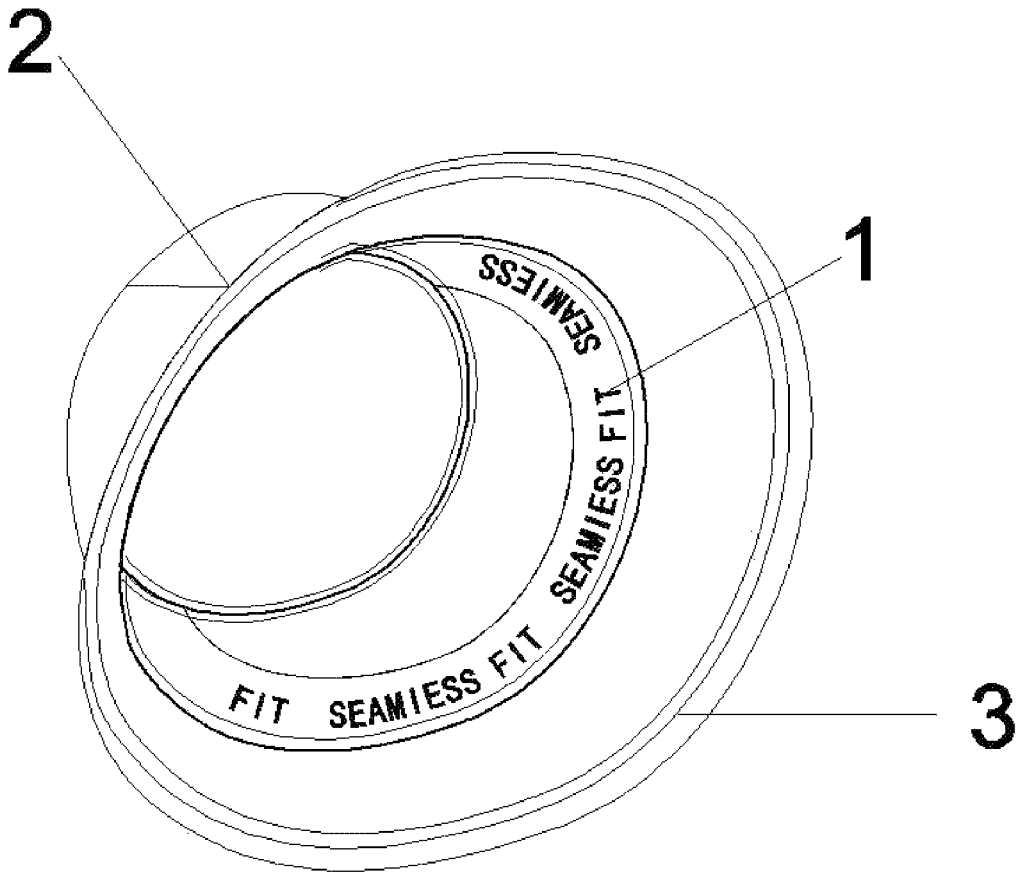
FIG. 5 is a schematic structural diagram of another cap with a seamless sweatband according to another embodiment of the disclosure.
Figure 6:
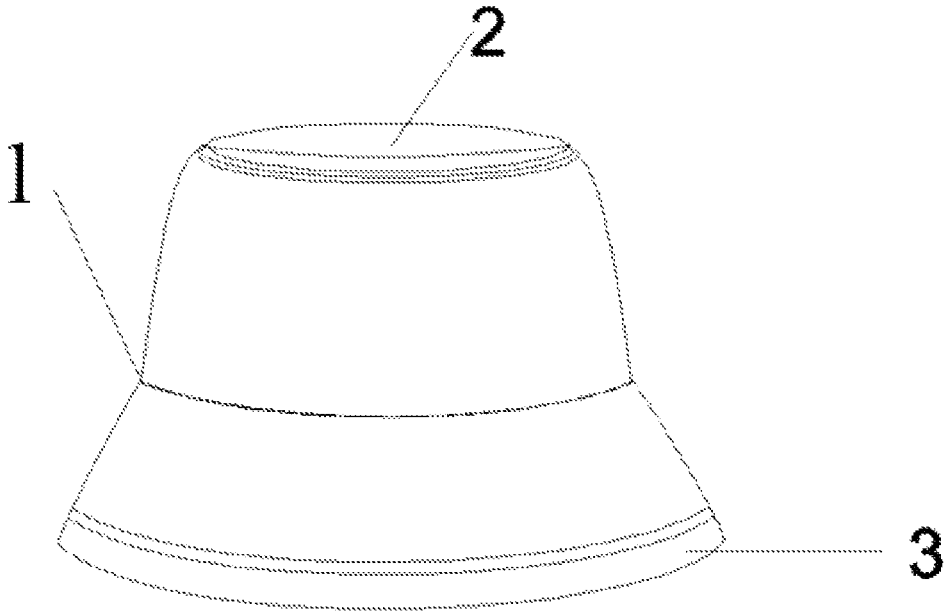
FIG. 6 is a schematic structural diagram of another cap with the seamless sweatband according to another embodiment of the disclosure.

Reference to FIG. 5, FIG. 6, in an illustrated embodiment of the disclosure, the cap body 2 can choose a cap without the cap peak 3, the seamless sweatband 1 is provided on a deeper inner brim of the cap body 2. When the cap body 2 is deeper, the seamless sweatband 1 is pressed against the interior of the cap body 2 to make it attached to people's forehead. When people wear the cap, the seamless sweatband 1 not only plays a role in the absorption of sweat, but also is more breathable and comfortable.

In an illustrated embodiment of the disclosure, the cap body 2 has a plurality of choices, such as a fisherman's cap, a sun cap, a peak cap, etc.

The disclosure provides a cap with ring-shaped, seamless, knot head free and adhesive free sweatband, keeps the cap appearance unchanged, increases the integrality of the whole cap, and suits for all kinds of head types. In addition, the disclosure increases portability in all application scenarios, promotes moisture absorption, perspiration drainage and fast drying of the cap, changes the complex procedure in conventional manufacturing process, reduces production costs and promotes production efficiency. The cap of the disclosure is foldable and portable but not deform. The cap can be rubbed, rolled and kneaded but recover quickly. The disclosure also feels excellent and uses easier.

The above description is only the exemplary embodiments of the disclosure, but the protection scope of the disclosure is not limited to this. Any equivalent structural transformations made under the inventive concept of the present disclosure, using the contents of the specification of the present disclosure and the accompanying drawings, or applied directly/indirectly in other related fields of technology shall be included in the protection scope of the disclosure.

What is claimed is:

1. A cap with a seamless sweatband, comprising:

a cap body;

the seamless sweatband, provided on an inner brim of the cap body; and a layer made of a sweat-absorbent cotton yarn, provided within the seamless sweatband;

a layer made of a spandex fiber, provided within the seamless sweatband; wherein the layer made of the spandex fiber is fixedly connected between an inner surface of the cap body and the layer made of the sweat-absorbent cotton yarn, and the layer made of the spandex fiber is in directly contact with the inner surface of the cap body;

wherein a thickness of the layer made of the sweat-absorbent cotton yarn is uneven, and the layer made of the sweat-absorbent cotton yarn comprises a plurality of protruding portions extending inwards from the layer made of the spandex fiber and configured to fit with a user head; and wherein the seamless sweatband is integrally formed and fixedly connected to the inner brim of the cap body.

2. The cap with the seamless sweatband according to claim 1, wherein the seamless sweatband is provided on an inner edge of the cap body.

3. The cap with the seamless sweatband according to claim 2, wherein a shape of the seamless sweatband is ring-shaped.

4. The cap with the seamless sweatband according to claim 3, wherein a thickness of the seamless sweatband is in a range of 1 mm to 5 mm, and a width of the seamless sweatband is in a range of 10 mm to 30 mm.

5. The cap with the seamless sweatband according to claim 3, wherein the cap body comprises a cap peak.

6. A cap with a seamless sweatband, comprising:

a cap body and a cap peak;

a spandex fiber layer, directly connected with an inner surface of the cap body and surrounding an edge of the cap body; and a sweat-absorbent cotton yarn layer, directly connected to an inner surface of the spandex fiber layer facing away from the cap body, wherein the sweat-absorbent cotton yarn layer comprises a plurality of protruding portions extending inward from the spandex fiber layer;

wherein the spandex fiber layer and the sweat-absorbent cotton yarn layer together form the seamless sweatband, and the seamless sweatband as a whole is integrated with the cap body and the cap peak.

* * * * *